US005760660A

United States Patent [19]

Nagatsu et al.

[11] Patent Number: 5,760,660

[45] Date of Patent: Jun. 2, 1998

[54] ORTHOGONAL POLARIZED WAVE BRANCHING FILTER AND ITS MANUFACTURING METHOD

[75] Inventors: Tatsuya Nagatsu; Yoshikazu Yoshimura, both of Osaka, Japan

[73] Assignee: Matsushita Electric Industrial Co., Ltd., Osaka, Japan

[21] Appl. No.: 727,683

[22] Filed: Oct. 8, 1996

[51] Int. Cl.[6] ..... H01P 5/08

[52] U.S. Cl. ..... 333/126; 333/21 R; 333/21 A

[58] Field of Search ..... 333/21 R, 21 A, 333/125, 126, 134, 137

[56] References Cited

U.S. PATENT DOCUMENTS

| | | | |
|---|---|---|---|
| 3,668,567 | 6/1972 | Rosen | 333/21 A |
| 4,717,897 | 1/1988 | Gehin et al. | 333/125 |

FOREIGN PATENT DOCUMENTS

| | | |
|---|---|---|
| 61-052002 | 3/1986 | Japan . |
| 62-169503 | 10/1987 | Japan . |
| 2-29001 | 1/1990 | Japan . |
| 5-55807 | 3/1993 | Japan . |
| 870873 | 6/1961 | United Kingdom . |

*Primary Examiner*—Paul Gensler
*Attorney, Agent, or Firm*—Ratner & Prestia

[57] ABSTRACT

On a terminal end plane of a circular waveguide, metal columnar blocks and a cross shaped branching transforming unit for branching two orthogonal linear polarized waves and transforming from circular $TE_{11}$ mode to rectangular $TE_{10}$ mode are disposed, and two rectangular waveguides are composed so as to form an angle of 45 degrees to the vertical axis and horizontal axis, that is, symmetrically to the axial center of the circular waveguide, in an electric field direction of the first linear polarized wave and an electric field direction of the second linear polarized wave. In this constitution, the orthogonal polarized wave branching filter of the microwave band for satellite communications can be reduced in size, and moreover the principal components can be formed integrally by an injection molding process.

17 Claims, 5 Drawing Sheets

ORTHOGONAL POLARIZED WAVE BRANCHING FILTER AND ITS MANUFACTURING METHOD

BACKGROUND OF THE INVENTION

The present invention relates to an orthogonal polarized wave branching filter for branching two kinds of linear polarized waves orthogonal to each other in a microwave band used in satellite communications.

Recently, in satellite broadcasting and satellite communications using the microwave band, waves having two linear polarized waves orthogonal to each other modulated by individual signals are being used. When receiving the modulated signals of two linear polarized waves, the two linear polarized waves must be individually separated. A first example of a conventional orthogonal polarized wave branching filter for this purpose is shown in FIG. 1. This is disclosed in Japanese Utility Model Laid-open No. 62-169503/1987. In FIG. 1, two linear polarized waves which are mutually orthogonal enter a circular waveguide 101 in a direction of an electric field as indicated by reference numerals 107 and 108 from an opening 118. The electric field 107 parallel to the horizontal axis will be identified as the first polarized wave, and the electric field 108 parallel to the vertical axis will be identified as the second polarized wave. A rectangular waveguide 105 for first polarized wave 107 is provided just above a coupled resonance window 111 so as to be orthogonal to the circular waveguide 111. A rectangular waveguide 106 for second polarized wave 108 is connected to a terminal end of the circular waveguide 101. A reflector 112 made of a metal material is fixed in tight contact with an inner wall of the circular waveguide 101 so as to be parallel to the coupled resonance window 111 at a specific position in the circular waveguide near the coupled resonance window 111.

In the conventional orthogonal polarized wave branching filter described above, of the waves entering the circular waveguide opening 118, the first polarized wave 107 is reflected because its electric field is parallel to the reflector 112, is not propagated further from the reflector 112, and is guided into the rectangular waveguide 105 through the coupled renounce window 111. On the other hand, the second polarized wave 108 having the electric field vertical to the reflector 112 is propagated up to the terminal end of the circular waveguide without being affected by the coupled resonance window 111 and reflector 112, and is transformed into a rectangular $TE_{10}$ mode in the smooth Junction (circular-rectangular converting portion) with the rectangular waveguide 106, and is guided into the rectangular waveguide 106.

FIG. 2 shows a second example of a conventional orthogonal polarized wave branching filter. This is disclosed in Japanese Patent Laid-open No. 2-29001/1990. In FIG. 2, from an opening 119 of a square waveguide 113 having one end short-circuited, mutually orthogonal linear polarized waves enter in a direction of the electric field as indicated by reference numerals 107 and 108. Herein, the wave 107, having a direction of the electric field parallel to the horizontal axis will be identified as the first polarized wave, and the wave 108 having a direction of electric field parallel to the vertical axis will be identified as the second polarized wave. Rectangular waveguides 115, 116 are provided at one side of the square waveguides 113 so as to be parallel to each other through a coupled resonance window. A plurality of conductor plates 114 are provided in the square waveguide 113 near the middle point of the rectangular waveguides 115, 116 so as to be parallel to the vertical axis. A 90-degree phase plate 117 is composed of a dielectric of specific shape and dielectric constant, and is provided in contact with a short-circuit end 120 of the square waveguide 113 so as to be at a 45 degree angle relative to the vertical axis and horizontal axis. The phase plate 117 works as a polarization rotation reflector for rotating the plane of polarization by 90 degrees.

When the first polarized wave 107 and second polarized wave 108 enter from the opening 119 of the square waveguide 113, the first polarized wave 107 is directed to the short-circuit end 120 of the square waveguide 113 without being affected by the conductor plate 114, and is reflected and rotated from the plane of polarization by the 90-degree phase plate 117 which is a polarized wave rotation reflector to become second polarized wave 108, which is directed toward the opening 119. Thus, the first polarized wave 107 is reflected by the conductor plate 114 and is completely sent out to the rectangular waveguide 115. On the other hand, the second polarized wave 108 is reflected by the conductor plates 114, and is not propagated up to the short-circuit end 120 of the square waveguide 113. Rather, it is completely sent out to the rectangular waveguide 116.

In such conventional constitution, however, since the two rectangular waveguides 115, 116 are installed at different distances from the opening 119, the overall length of the orthogonal polarized wave branching filter is long as a matter of course. In addition, it is necessary to install the reflector (conductor plate) 114 and 90-degree phase plate 117, and it is impossible to form these components integrally by using an injection molding means. Accordingly, in mass production, the number of parts and processes increase, and it is hard to assure stable performance due to mounting error.

SUMMARY OF THE INVENTION

To solve the problems of the prior art, hence, it is an object of the invention to present an orthogonal polarized wave branching filter reduced in the number of parts by eliminating the hitherto required reflector (conductor plate) and 90-degree phase plate, which is stable in performance by eliminating the mounting process, and which is small in size, high in performance, and formable by injection molding by disposing the rectangular waveguides at an equal distance from the opening.

To achieve the above object, a basic constitution of an orthogonal polarized wave branching filter of the invention comprises a circular waveguide having a terminal end for transmitting a first linear polarized wave, and a second linear polarized wave orthogonal to the first linear polarized wave, first and second rectangular waveguides connected from the terminal end of the circular waveguide in the direction of each electric field direction of the first and second linear polarized waves, and a branching transforming unit made of a metal material in a cross form provided in the terminal end plane of the circular waveguide with the longitudinal direction parallel to the direction of each electric field of the first and second linear polarized waves about the axial center of the circular waveguide.

The first and second rectangular waveguides are deflected in halving directions of the electric field directions of the first and second linear polarized waves after branching at the terminal end of the circular waveguide to be parallel to each other, with the opening surfaces on a same plane, and current is supplied from the same plane.

In this constitution, two orthogonal polarized waves can be produced at positions which are at equal distances from the opening of the circular waveguide, so that the entire size of the branching filter can be reduced.

As the means for transforming the transmission mode in the circular waveguide and in the rectangular waveguide efficiently between the circular $TE_{11}$ mode and rectangular $TE_{10}$ mode, the rectangular waveguide side of the cross shaped branching transforming unit is formed in steps.

Moreover, by forming a metal columnar block in plural steps becoming smaller in diameter moving away from the terminal end of the circular waveguide in the middle of the cross shaped branching transforming unit, in a shape overlaid on the axial center of the circular waveguide, undesired wave leak between the first and second rectangular waveguides may be prevented.

Incidentally, the operation is unchanged if the circular waveguide of this basic constitution is replaced by a square wave guide having two sides each parallel in the electric field direction of each linear polarized wave, and the partial constitution added to this basic constitution also acts similarly as above.

In these constitutions, by forming the circular waveguide or square waveguide in a taper shape varying wider from the terminal end to the opening, forming the cross shaped branching transforming unit and, if necessary, the metal columnar block in plural steps in a taper shape varying narrower from the terminal end to the opening, and forming the rectangular waveguide in a taper shape varying wider toward the opening, it is possible to form the waveguide integrally by injection molding means, and therefore the number of parts and processes can be curtailed, the production cost is reduced, fluctuations of performance and deterioration due to mounting error can be prevented, and the performance stability and productivity improvement to mass production are outstanding.

EMBODIMENTS

Figure 1:
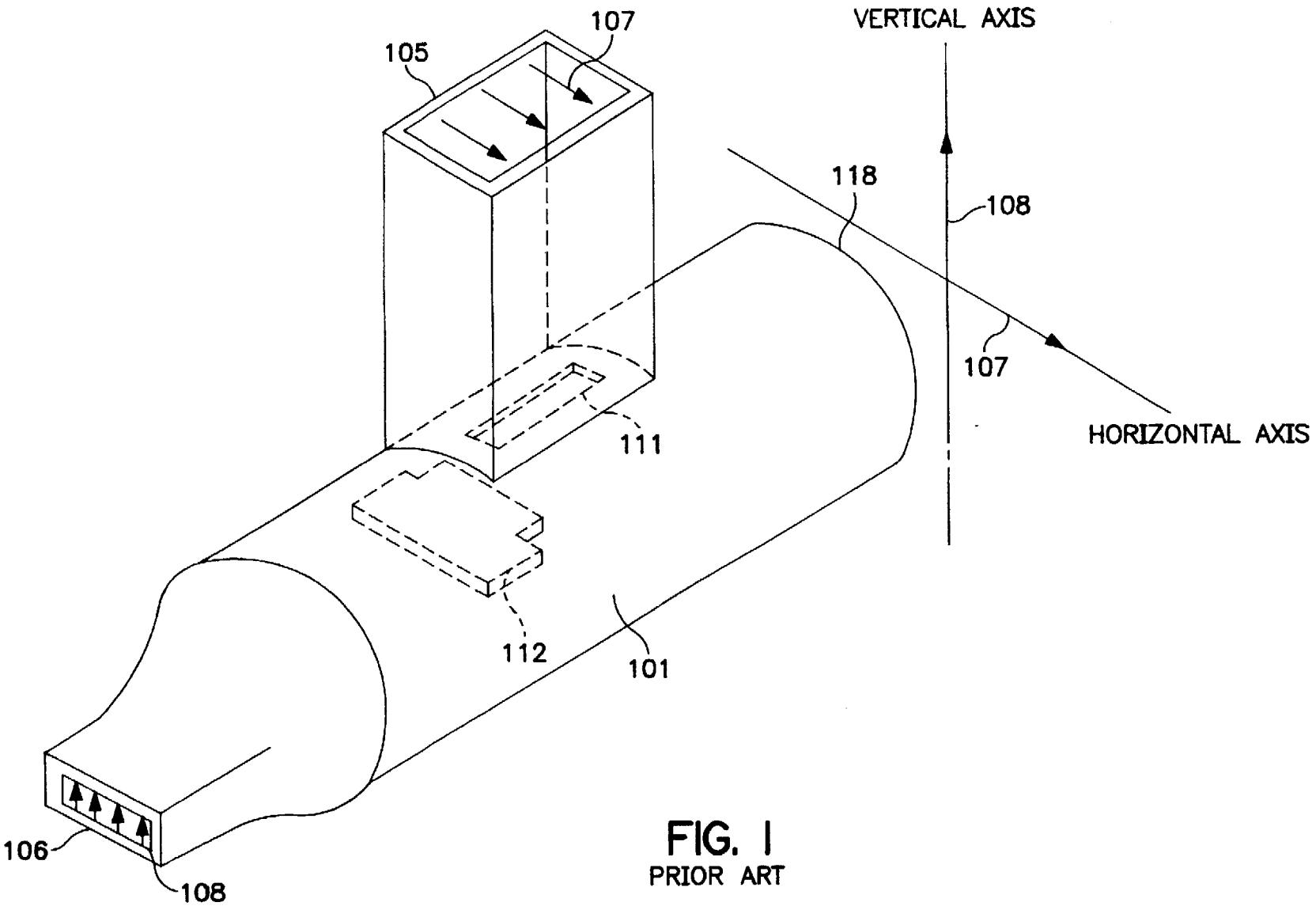
FIG. 1 PRIOR ART
FIG. 1 is a perspective view of an orthogonal polarized wave branching filter in accordance with the prior art.

Referring now to the drawings, an embodiment of the invention is described below.

Figure 3:
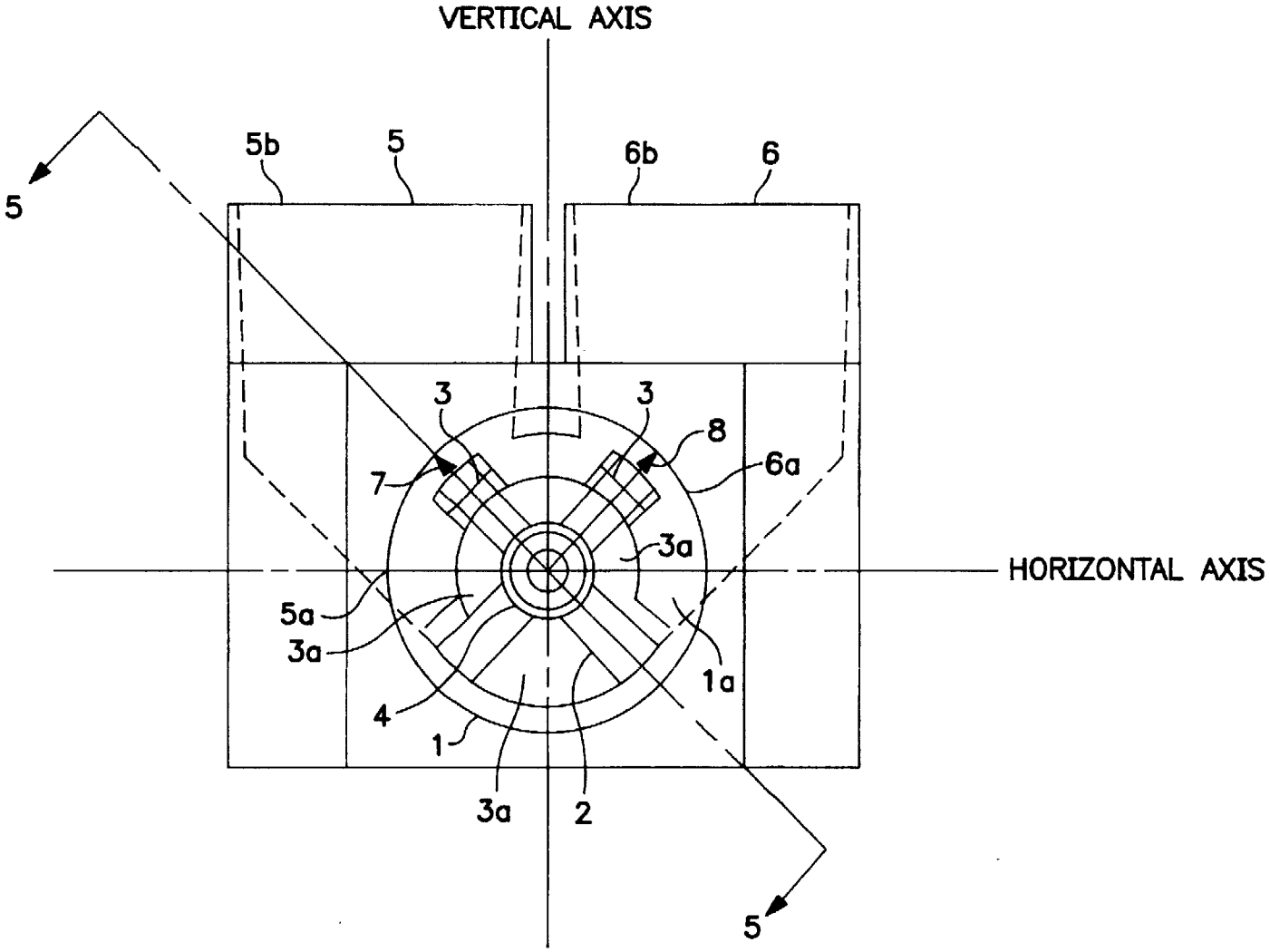
FIG. 3 is a front view of an orthogonal polarized wave branching filter in accordance with an embodiment of the invention.
Figure 4:
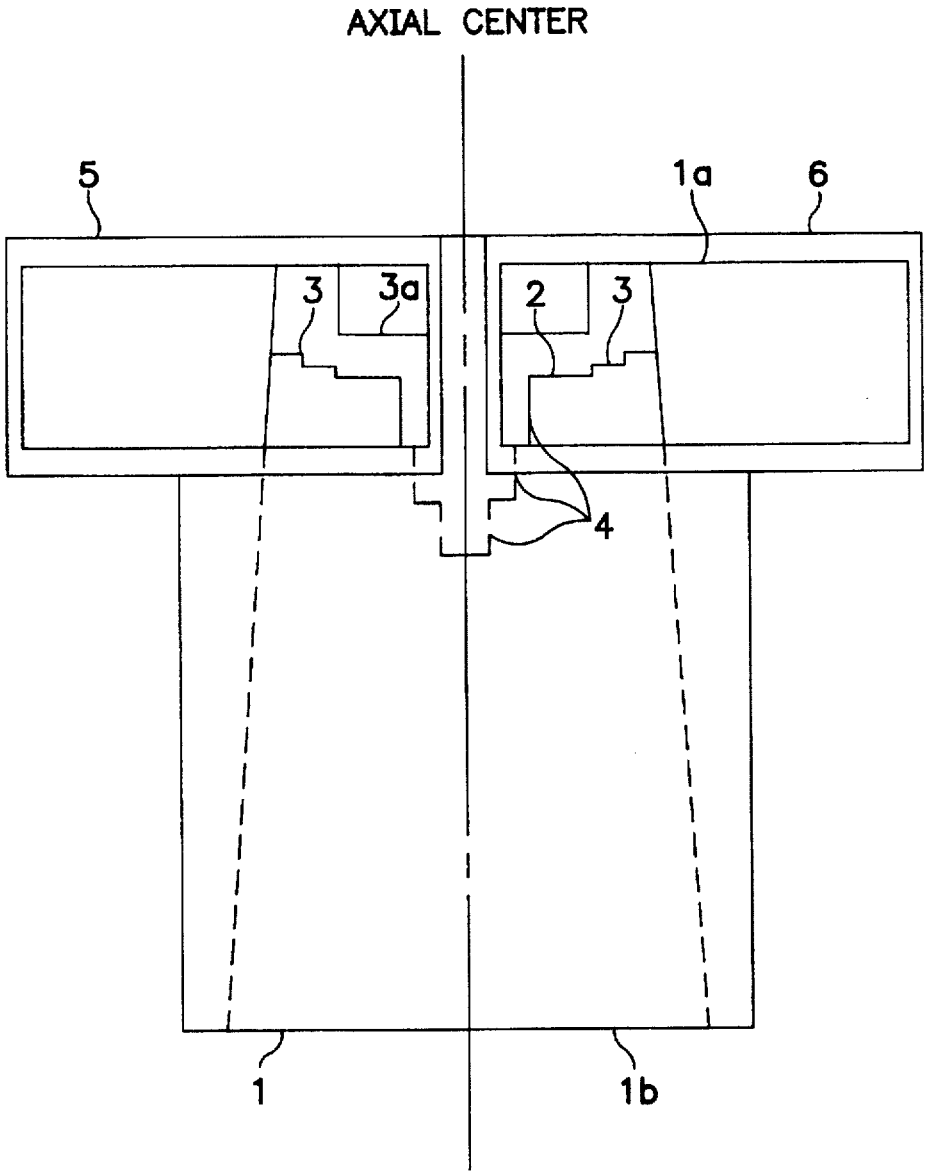
FIG. 4 is a plan view of an orthogonal polarized wave branching filter in accordance with an embodiment of the invention.

FIG. 3 is a front view and FIG. 4 is a plan view of an orthogonal polarized wave branching filter in accordance with an embodiment of the invention. The longitudinal direction of a branching transforming unit 2 is disposed at a terminal end plane 1*a* of a terminal end portion of a taper shaped circular waveguide 1 opened in the direction of an opening 1*b*, in a direction at an angle of 45 degrees to the vertical axis and horizontal axis. That is, the longitudinal direction of the branching transforming unit 2 is disposed so as to coincide with an electric field direction 7 of a first linear polarized wave of the circular waveguide 1 and an electric field direction 8 of a second linear polarized wave, so as to be formed in a cross shape. Closely to the terminal end plane 1*a* of the terminal end portion of the circular waveguide 1, an opening 5*a* of a rectangular waveguide 5 is disposed in the direction of the electric field direction 7 of the first linear polarized wave, and similarly closely to the terminal end plane 1*a* of the terminal end portion of the circular waveguide 1, an opening 6*a* of a rectangular waveguide 6 is disposed in the direction of the electric field direction 8 of the second linear polarized wave.

A three-step portion 3 of the cross shaped branching transforming unit 2 is disposed at the side of rectangular waveguides 5,6.

The rectangular waveguides 5, 6 for first and second linear polarized waves are deflected at specified positions, and are installed so that the individual opening surfaces 5*b*, 6*b* may be parallel to the horizontal axis, that is, each central axis may be parallel to the bisector direction of the electric field direction 7 of the first linear polarized wave and the electric field direction 8 of the second linear polarized wave, or in the vertical axis direction.

Figure 5:
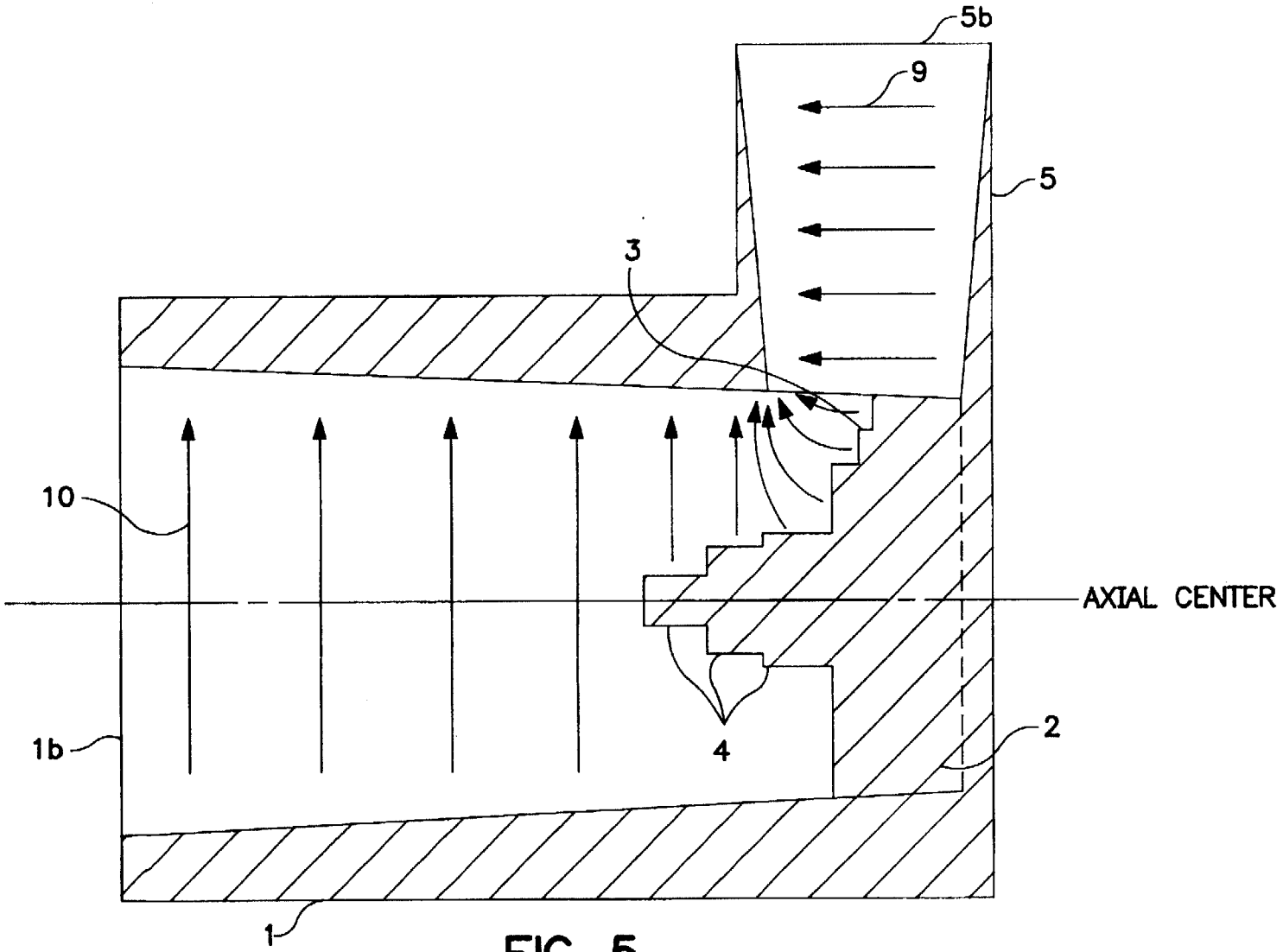
FIG. 5 is a sectional view along cut line 5—5 of FIG. 3.

Metal columnar blocks 4 differing in diameter in three stages are overlaid on the axial center of the circular waveguide in the center of the cross shaped branching transforming unit 2. FIG. 5 is a sectional view of FIG. 3 cut along line 5—5 at an angle of 45 degrees to the vertical axis.

A base portion 3*a* is formed slightly lower than the steps 3, and this portion is provided for impedance matching.

The operation of the orthogonal polarized wave branching filter of the embodiment of the invention thus constituted is described below while referring to the drawings.

The $TE_{11}$ mode of the circular waveguide and $TE_{10}$ mode of the rectangular waveguide can be easily transformed because they are nearly the same in electromagnetic field distribution. As shown in FIG. 1, by gradually deforming the circular waveguide into a rectangular waveguide, or, to the contrary, by gradually transforming the rectangular waveguide into a circular waveguide, the modes can be transformed.

In the case of this embodiment, since the rectangular waveguides 5,6 are connected at right angle to the circular waveguide 1, the method as shown in FIG. 1 cannot be employed. Instead, the modes are transformed by making use of the fact that both modes are similar.

In the case of circular waveguides, the electromagnetic field distribution is dense in the center and sparse at the ends. In the center, moreover, the electromagnetic field distribution is almost the same as in the rectangular waveguide. That is, in the case of circular waveguide, it is necessary to consider only the electromagnetic field distribution near the center, and considering near the center, the $TE_{11}$ mode of the circular waveguide and $TE_{10}$ mode of rectangular waveguide may be regarded as being identical. Accordingly, in the steps 3 of the embodiment, by properly selecting the height of each step as shown in FIG. 5, coupling of electromagnetic fields occurs between the seam of the circular waveguide 1 and rectangular waveguide 5 or 6 and the flat plane of the steps 3, and the electromagnetic field is gradually bent, finally bending 90 degrees. This ends the bending of the electromagnetic field, and also terminates the mode transformation.

Transformation from the rectangular waveguide 5 or 6 side is also the same. By feeding current in the rectangular $TE_{10}$ mode 9 from the rectangular waveguide 5 side as shown in the diagram, it is efficiently transformed into the circular $TE_{11}$ mode 10 by the steps 3 of the cross shaped branching transforming unit 2, thereby appearing in the opening plane 1*b* of the circular waveguide 1.

At this time, by the effect of the metal columnar blocks 4, the wave is not coupled with the rectangular waveguide 6, and the wave supplied from the rectangular waveguide 5 completely appears on the opening plane 1*b* of the circular waveguide 1.

This reason is explained. In FIG. 3, suppose only the first polarized wave of electric field direction 7 enters from the circular waveguide 1. If metal columnar blocks 4 are not provided, the electric field spreads and propagates in the entire circular waveguide 1, and is partly coupled with the rectangular waveguide 6 for the second polarized wave and propagates, and therefore it is sent out to the opening plane of the rectangular waveguide 6 for the second polarized wave in which it is not supposed to appear in principle. By contrast, when the metal columnar blocks 4 are provided, since the electric field is present between the inner wall of the columnar waveguide 1 near the rectangular waveguide 5 for the first polarized wave and the metal columnar blocks 4, the electric field 7 of the first polarized wave is not present near the rectangular waveguide 6 for the second polarized wave, and hence it will not be coupled with the rectangular waveguide 6 for the second polarized wave. Therefore, all of the first polarized wave 7 is issued from the rectangular polarized wave 5 for the first polarized wave.

Similarly, in the case of entrance in rectangular $TE_{11}$ mode from the rectangular waveguide 5 for the first polarized wave, the electric field transformed into the $TE_{11}$ mode of the circular waveguide by the steps 3 similarly propagates between the inner wall at the rectangular waveguide 5 side for the first polarized wave and the metal columnar blocks 4, and hence will not be coupled with the rectangular waveguide 6 for the second polarized wave. That is, the metal columnar blocks 4 play a role to limit the spreading of the electric field.

The wave appearing on the opening plane 1*b* of the circular waveguide 1 is a first linear polarized wave of electric field direction 7 as shown in FIG. 3. Similarly, by feeding current from the rectangular waveguide 6, all supplied waves are transformed in mode and are sent out to the opening plane 1*b* of the circular waveguide 1. At this time, the wave is changed to the second linear polarized wave of electric field direction 8 as shown in FIG. 3. At this time, the opposite side portion to the waveguides 5, 6 with respect to the central axis of the cross shaped branching transforming unit 2 plays the role of impedance matching of waveguides 5, 6 and circular waveguide 1.

To the contrary, in FIG. 3, when the first and second linear polarized waves of electric field directions 7 and 8 are entered from the opening plane 1*b* of the circular waveguide 1, they are branched efficiently by the plural stages of metal columnar blocks 4, and all of the first polarized wave in the electric field direction 7 is sent out from the rectangular waveguide 5, and all of the second polarized wave in the electric field direction 8 is sent out from the rectangular waveguide 6.

As is clear from FIG. 3, the inside of the circular waveguide 1 is in a taper form expanding widely to the closer side in the axial direction, and the cross shaped branching transforming unit 2 and metal columnar blocks 4 are in a taper form narrower toward the closer side in the axial direction. The rectangular waveguides 5, 6 are in a taper form expanding wider toward the upward direction. Thus, the circular waveguide 1, rectangular waveguides 5, 6 cross shaped branching transforming unit 2 including steps 3, and metal columnar blocks 4 can be formed integrally by the manufacturing method of injection molding, by disposing a slide core to be inserted from before in the drawing into a die opening in the vertical direction in FIG. 3 and of which the upper side is a male pattern. As molding material, aluminum, for example, is preferred. Alternatively, only the cross shaped branching transforming unit 2 and metal columnar blocks 4 may be manufactured from other parts by cutting or other method, and attached to the formed main body by press fitting, screw fixing or the like after molding. The steps 3 and metal columnar blocks 4 are both in three stages, but, they may be also formed in two or four stages as required, and the detail of the number or dimension is not particularly limited.

The circular waveguide may be replaced by a square waveguide in which two orthogonal linear polarized waves can be used. When replaced with a square waveguide having two sides parallel to the 5—5 section in FIG. 3, that is parallel to the electric field direction 7 of the first linear polarized wave, and two sides parallel to the electric field direction 8 of the second linear polarized wave, it is easy to understand that the same action as explained by reference to FIG. 3 to FIG. 5 may be obtained.

Thus, according to the invention, in the orthogonal polarized wave branching filter, the entire size of the branching filter can be reduced by sending out two orthogonal polarized waves at positions at an equal distance from the opening of the circular waveguide.

Moreover, by disposing the metal columnar blocks and cross shaped branching transforming unit for branching two orthogonal polarized waves on the terminal end plane of the terminal end portion of the circular waveguide, forming the circular waveguide, metal columnar blocks, cross shaped branching transforming unit, and rectangular waveguide in a taper form, and forming the entire branching filter integrally by injection molding process, not only the manufacturing and mounting steps of the hitherto required reflector (conductor plate) and 90-degree phase plate can be omitted, but also performance fluctuations and an adjusting process due to mounting error in mass production can be eliminated, so that stable performance and notable enhancement of productivity may be presented.

Figure 2:
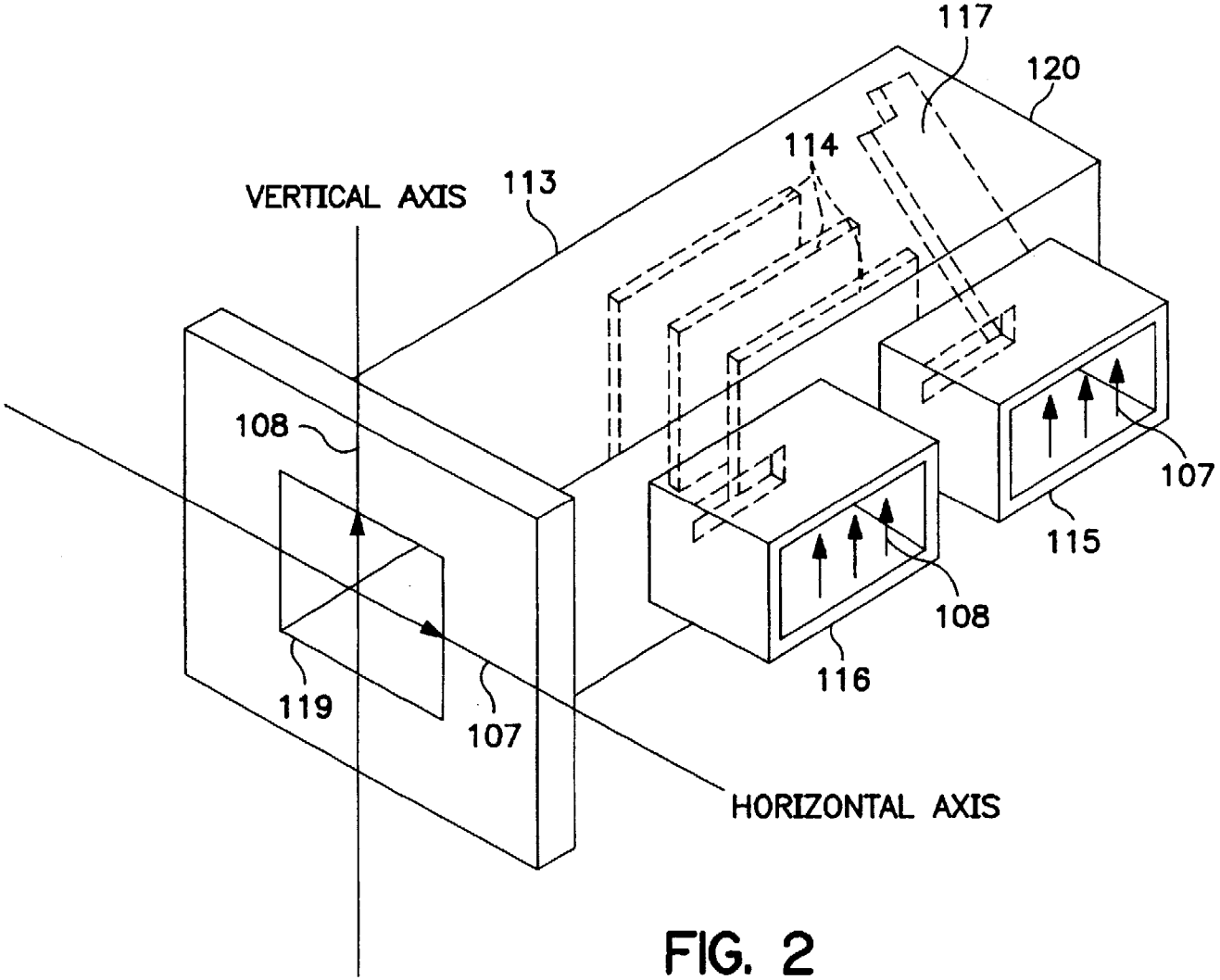
FIG. 2 PRIOR ART
FIG. 2 is a perspective view of an orthogonal polarized wave branching filter in accordance with the prior art.

The invention may be embodied in several forms without departing from the spirit of essential characteristics thereof. For example, the circular waveguide may be replaced by the square waveguide having sides in the electric field direction of the first polarized wave and the electric field direction of the second polarized wave as shown in FIG. 2. Therefore, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An orthogonal polarized wave branching filter comprising:

a circular waveguide having a closed terminal end, said circular waveguide for transmitting a first linear polarized wave and a second linear polarized wave orthogonal to the first linear polarized wave, first and second rectangular waveguides coupled to the terminal end of the circular waveguide in a direction of each electric field direction of the first and second linear polarized waves, and a branching transforming unit made of a metal material in a cross shape provided in the terminal end plane of the circular waveguide with the cross shape parallel to the direction of each electric field of the first and second linear polarized waves about the axial center of the circular waveguide.

2. An orthogonal polarized wave branching filter of claim 1, wherein the rectangular waveguide side of the cross shaped branching transforming unit is formed in stairs.

3. An orthogonal polarized wave branching filter of claim 1, wherein metal columnar blocks in plural stages becoming smaller in diameter going away from the terminal end of the circular waveguide are overlaid in the center of the cross shaped branching transforming unit, on the axial center of the circular waveguide.

4. An orthogonal polarized wave branching filter according to claim 1, wherein the circular waveguide in a taper form expands from the terminal end portion toward the opening portion, the cross shaped branching transforming unit in a taper form narrows from the terminal end portion toward the opening portion, and the rectangular waveguide in a taper form expands toward the opening portion.

5. An orthogonal polarized wave branching filter according to claim 1, wherein metal columnar blocks in plural stages becoming smaller in diameter going away from the terminal end of the circular waveguide are overlaid in the center of the cross shaped branched transforming unit, on the axial center of the circular waveguide, in a taper form becoming narrower toward the opening portion of the circular waveguide.

6. An orthogonal polarized wave branching filter according to claim 1, wherein the cross shaped branching transforming unit and metal columnar blocks in plural stages are fabricated from metal parts, and are attached to the terminal end plane of the terminal end portion of the circular waveguide.

7. An orthogonal polarized wave branching filter of claim 1, wherein the first and second rectangular waveguides are disposed above respective portions of said branching transforming unit, and said branching transforming unit coupling said first and second linear polarized waves to said first and second rectangular waveguides, respectively, in a parallel direction to each respective waveguide.

8. An orthogonal polarized wave branching filter comprising:

a circular waveguide having a closed terminal end, said circular waveguide for transmitting a first linear polarized wave and a second linear polarized wave orthogonal to the first linear polarized wave, first and second rectangular waveguides connected from the terminal end of the circular waveguide in a direction of each electric field direction of the first and second linear polarized waves, and a branching transforming unit made of a metal material in a cross shape provided in the terminal end plane of the circular waveguide with the cross shape parallel to the direction of each electric field of the first and second linear polarized waves about the axial center of the circular waveguide, wherein the first and second rectangular waveguides are deflected in halving directions of electric field directions of the first and second linear polarized waves after branching at the terminal end of the circular waveguide to be parallel to each other, with the opening surfaces on a same plane, and current is supplied from the same plane.

9. An orthogonal polarized wave branching filter comprising:

a square waveguide having a closed terminal end, said square waveguide for transmitting a first linear polarized wave and a second linear polarized wave orthogonal to the first linear polarized wave, first and second rectangular waveguides coupled to the terminal end of the square waveguide in a direction of each electric field direction of the first and second linear polarized waves, and a branching transforming unit made of a metal material in a cross shape provided in the terminal end plane of the square waveguide with the cross shape parallel to the direction of each electric field of the first and second linear polarized waves about the axial center of the square waveguide.

10. An orthogonal polarized wave branching filter of claim 9, wherein the rectangular waveguide side of the cross shaped branching transforming unit is formed in stairs.

11. An orthogonal polarized wave branching filter of claim 9, wherein metal columnar blocks in plural stages becoming smaller in diameter going away from the terminal end at the square waveguide are overlaid in the center of the cross shaped branching transforming unit, on the axial center of the square waveguide.

12. An orthogonal polarized wave branching filter according to claim 9, wherein the square waveguide in a taper form expands from the terminal end portion toward the opening portion, the cross shaped branching transforming unit in a taper form narrows from the terminal end portion toward the opening portion, and the rectangular waveguide in a taper form expands toward the opening portion.

13. An orthogonal polarized wave branching filter according to claim 9, wherein metal columnar blocks in plural stages becoming smaller in diameter going away from the terminal end of the square waveguide are overlaid in the center of the cross shaped branching transforming unit, on the axial center of the square waveguide, in a taper form becoming narrower toward the opening portion of the circular waveguide.

14. An orthogonal polarized wave branching according to claim 9, wherein the cross shaped branching transforming unit and metal columnar blocks in plural stages are fabricated from metal parts, and are attached to the terminal end plane of the terminal end portion of the square waveguide.

15. An orthogonal polarized wave branching filter of claim 9, wherein the first and second rectangular waveguides are disposed above respective portions of said branching transforming unit, and said branching transforming unit coupling said first and second linear polarized waves to said first and second rectangular waveguides, respectively, in a parallel direction to each respective waveguide.

16. An orthogonal polarized wave branching filter comprising:

a square waveguide having a closed terminal end, said square waveguide for transmitting a first linear polarized wave and a second linear polarized wave orthogonal to the first linear polarized wave, first and second rectangular waveguides connected from the terminal end of the square waveguide in a direction of each electric field direction of the first and second linear polarized waves, and a branching transforming unit made of a metal material in a cross shape provided in the terminal end plane of the square waveguide with the cross shape parallel to the direction of each electric field of the first and second linear polarized waves about the axial center of the square waveguide, wherein the first and second rectangular waveguides are deflected in halving directions of electric field directions of the first and second linear polarized waves after branching at the terminal end of the square waveguide to be parallel to each other, with the opening surfaces on a same plane, and current is supplied from the same plane.

17. An orthogonal polarized wave branching filter comprising:

a circular waveguide having a closed terminal end, said circular waveguide for transmitting a first linear polarized wave and a second linear polarized wave orthogonal to the first linear polarized wave, first and second rectangular waveguides coupled to the terminal end of the circular waveguide in a direction of each electric field direction of the first and second linear polarized waves, a branching transforming unit made of a metal material in a cross shape provided in the terminal end plane of the circular waveguide, the cross shape i) parallel to the direction of each electric field of the first and second linear polarized waves about the axial center of the circular waveguide and ii) forming a plurality of steps from an end of the branching transformer unit to the terminal end plane of the circular waveguide.

* * * * *

UNITED STATES PATENT AND TRADE MARK OFFICE

CERTIFICATE OF CORRECTION

PATENT NO. : 5,760,660
DATED : June 2, 1998
INVENTOR(S) : T. Nagatsu et al.

It is certified that error appears in the above-identified patent and that said Letters Patent is hereby corrected as shown below:

On the cover page, item [54] in the title, delete "ORTHOGONAL POLARIZED WAVE BRANCHING FILTER AND ITS MANUFACTURING METHOD" and insert --ORTHOGONAL POLARIZED WAVE BRANCHING FILTER--.

Signed and Sealed this

Second Day of February, 1999

*Attest:*

*Attesting Officer*

*Acting Commissioner of Patents and Trademarks*